United States Patent [19]

Nelson

[11] Patent Number: 4,550,468

[45] Date of Patent: Nov. 5, 1985

[54] MOP

[76] Inventor: Marguerite D. Nelson, 415 N.E. 65th Ave., Portland, Oreg. 97213

[21] Appl. No.: 660,298

[22] Filed: Oct. 12, 1984

[51] Int. Cl.[4] ..... A47L 13/20

[52] U.S. Cl. ..... 15/229 A; 15/147 R

[58] Field of Search ..... 15/229 R, 229 A, 229 AC, 15/229 AP, 229 B, 229 BC, 229 BP, 228, 147 R, 147 A, 234, 209 R, 226

[56] References Cited

U.S. PATENT DOCUMENTS 3,737,938 6/1973 Saltzstein ..... 15/147 A X

*Primary Examiner*—Edward L. Roberts

*Attorney, Agent, or Firm*—Eugene M. Eckelman

[57] ABSTRACT

A mop handle has a Velcro strip secured to the lower end thereof and a mop head has a Velcro strip secured around the inner surface thereof. The Velcro strip on the mop head is arranged for releasable engagement with the Velcro strip on the handle whereby the mop head is readily attached and detached. The outer surface of the mop head has Velcro elements to provide an exterior band.

4 Claims, 3 Drawing Figures

MOP

BACKGROUND OF THE INVENTION

This invention relates to new and useful improvements in mop structures.

Various types of mop heads have heretofore been devised some of which include a metal clamping head arranged to receive the cloth and arranged to release the mop head for cleaning or replacement. This type of mop head is inconvenient since the metal parts thereof generally become rusted or corroded, making it difficult to remove or install the mop material. Also, this type of mop head can scratch or otherwise damage the floor.

Another type of mop head comprises simply strand material secured to the lower end of the mop handle and the entire unit is discardable when the mop head is worn.

SUMMARY OF THE INVENTION

According to the present invention and forming a primary objective of the invention, a mop is provided having an all fabric head which is not capable of damaging the floor, which is readily attachable to and detachable from the mop handle, and which is capable of being cleaned in a conventional type washing machine.

In carrying out the objectives of the invention, the mop includes a handle and a mop head having a floor cleaning end and an attaching end for attachment to one end of the handle. This attaching end comprises a wrap-around portion arranged to wrap around the lower end of the handle. Fabric-type interengaging releasable elements are secured on each of the lower end of the handle and an inner surface of the mop head whereby the latter is arranged to be releasably wrapped around the lower end of the handle for ready attachment and detachment. The mop head may also include a tab secured to the outer surface of its attaching end and fabric-type interengaging releasable elements secured on each of said outer surface and on the tab whereby the latter can encircle the mop head and provide an outer releasable securing band around the attaching end.

The invention will be better understood and additional objects and advantages will become apparent from the following description taken in connection with the accompanying drawings.

DETAILED DESCRIPTION OF A PREFERRED EMBODIMENT

Figure 1:
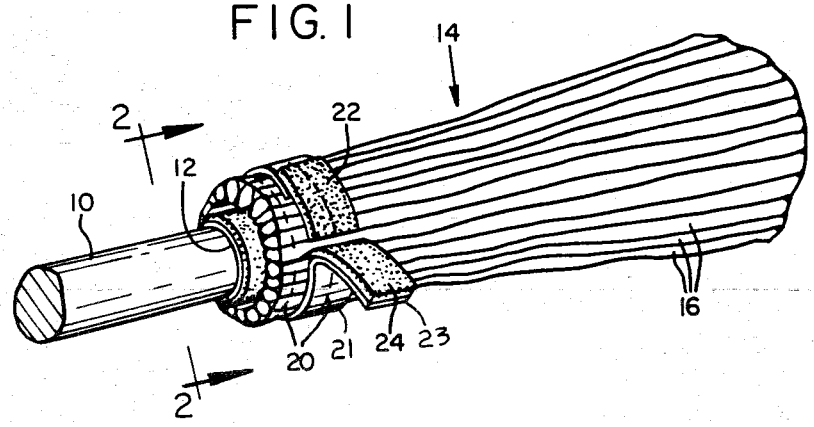
FIG. 1 is a perspective view of the present mop, the mop head being secured on the handle but the outer band thereof being in the process of being attached.
Figure 2:
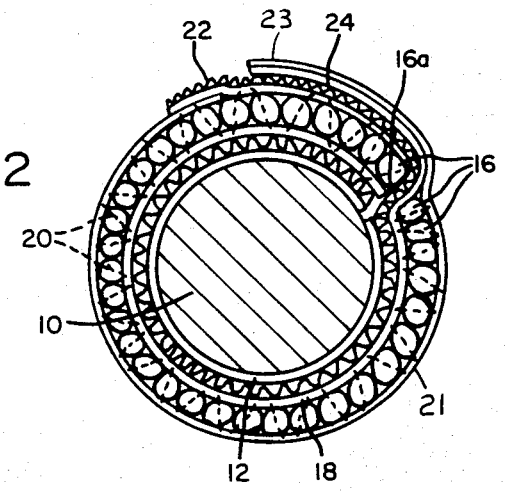
FIG. 2 is a sectional view taken on the line 2—2 of FIG. 1.
Figure 3:
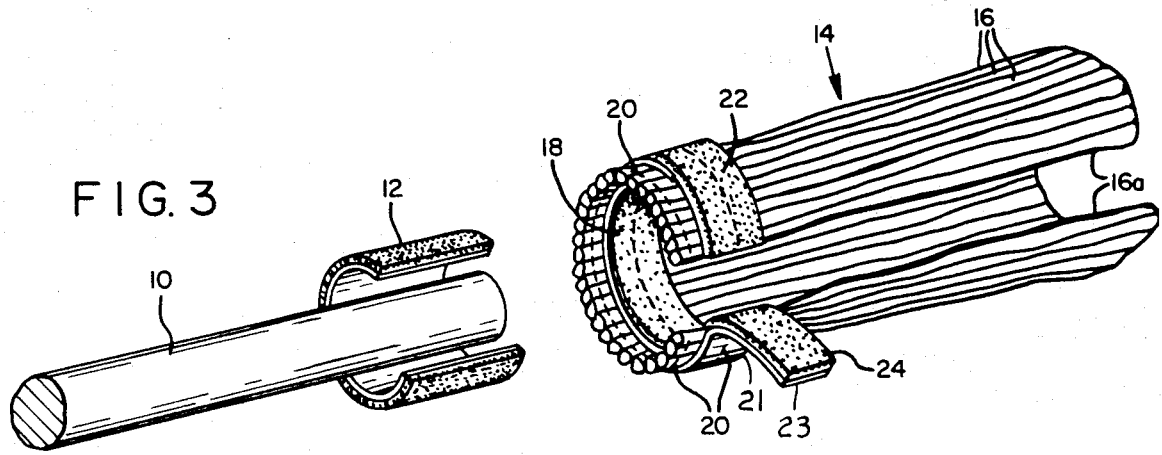
FIG. 3 is an exploded view showing construction and assembly of the mop.

With particular reference to the drawings, the present invention comprises a mop handle 10 having a strip of fabric-type releasable element 12, such as Velcro, permanently secured to the lower end thereof, as by a suitable adhesive.

The mop head is designated generally by the numeral 14 and comprises a plurality of the conventional strands 16 or other mop material. One end of the strands is secured together by a cross strip 18 of a fabric-type releasable element, such as Velcro, arranged for wrap-around releasable engagement with the strip 12. In the construction of the mop head, the strip 18 is secured to the strands while in a flat condition, whereby to facilitate ease of manufacture. The strip of Velcro 18 is secured to the one surface which comprises the inner surface when wrapped around the handle portion. Securement of the strip 18 to the strands 16 is readily accomplished by stitching 20.

It is preferred, although not necessary, to utilize an outer attaching band arranged to provide a positive securement of the mop head on the handle. For this purpose, an outer strip 21 is secured to the outer surface of the mop head in the area of strip 18. The strip 21 has a Velcro portion 22 secured thereto which terminates at one of the longitudinal edges **16*a* of the mop head. Securement of the strip 21 to strip 18 and of the strip 21 to the Velcro portion 22 can also be accomplished by the stitching 20. Strip 21 has an extension 23 at its other end which projects past the longitudinal edge 16*a* opposite from the edge 16*a* adjacent the Velcro portion 22, and extension 23 is secured to a Velcro extension 24 of the adjacent end of the inner strip 18. Velcro portion 24 when engaged with the Velcro portion 22 extends across the edges 16*a*** to provide a positive attachment of the mop head on the handle.

According to the present invention, a mop is provided which is inexpensive to manufacture, namely, the Velcro strip 12 is readily applied to the lower edge of the handle 10 and the mop head itself is readily constructed by securing the strands 16 together by the Velcro strips 18 and 21 while in flat condition. The mop head is readily applied to the handle by wrapping the Velcro portion 18 around the handle Velcro portion 12 and by pulling tight on the tab 23 and connecting the Velcro portions 22 and 24. The mop head likewise is readily detached for washing or replacement. The mop head has no metal parts capable of scratching the floor and furthermore since it is all fabric, it can be washed in a conventional type washing machine.

It is to be understood that the form of my invention as herein shown and described is to be taken as a preferred example of the same and that various changes in the shape, size and arrangement of parts may be resorted to without departing from the spirit of the invention, or the scope of the subjoined claims.

Having thus described my invention, I claim:

1. A mop comprising:

(a) a handle having opposite ends, (b) a mop head having a floor cleaning end and an attaching end for attachment to one end of said handle, (c) said attaching end comprising a wrap-around portion having inner and outer surfaces, (d) and fabric-type interengaging releasable elements secured on each of said one end of the handle and on said inner surface of the wrap-around portion whereby the latter is arranged to be wrapped around said one end of the handle for engagement of said releasable elements for ready attachment to and detachment from said handle.

2. The mop of claim 1 wherein said releasable elements comprise Velcro.

3. The mop of claim 1 wherein said mop head comprises a flat body portion, said floor cleaning end thereof comprising a plurality of strands, said releasable element on said mop head securing said strands together at said attaching end.

4. The mop head of claim 3 wherein said outer surface of said attaching end has a tab secured thereto, and fabric-type interengaging releasable elements on each of said outer surface and on said tab whereby the latter is arranged to extend at least partially around said mop head and provide an outer releasable securing band on said attaching end.

* * * * *